US008622145B2

(12) United States Patent
Guse

(10) Patent No.: US 8,622,145 B2
(45) Date of Patent: Jan. 7, 2014

(54) FIREFIGHTING STATION

(76) Inventor: James D. Guse, Edina, MN (US)

( * ) Notice: Subject to any disclaimer, the term of this patent is extended or adjusted under 35 U.S.C. 154(b) by 266 days.

(21) Appl. No.: 13/172,994

(22) Filed: Jun. 30, 2011

(65) Prior Publication Data

US 2012/0000680 A1 Jan. 5, 2012

Related U.S. Application Data

(60) Provisional application No. 61/360,275, filed on Jun. 30, 2010.

(51) Int. Cl.
*A62C 2/00* (2006.01)

(52) U.S. Cl.
USPC ..... 169/44; 169/14; 169/15; 169/52; 239/10; 239/146; 239/304; 239/310

(58) Field of Classification Search
USPC ..... 169/44, 13, 14, 15, 52, 70; 239/10, 304, 239/310, 146
See application file for complete search history.

(56) References Cited

U.S. PATENT DOCUMENTS 3,220,482 A * 11/1965 Eveleth ..... 169/47
4,612,595 A 9/1986 Gill et al.
4,725,370 A 2/1988 Greene
5,167,285 A 12/1992 Williams et al.
5,312,041 A 5/1994 Williams et al.
5,837,168 A 11/1998 Rowe
6,086,052 A 7/2000 Rowe
6,109,359 A 8/2000 Ballard
6,138,994 A 10/2000 Rowe
6,217,009 B1 4/2001 Rowe
6,357,532 B1 3/2002 Laskaris et al.
6,761,226 B2 * 7/2004 Carrier et al. ..... 169/24
7,048,068 B2 5/2006 Pualkovich
7,104,336 B2 9/2006 Ozment
7,334,644 B1 2/2008 Ozment
7,464,992 B1 12/2008 Ozment
7,588,612 B2 9/2009 Marwitz et al.
2005/0224239 A1 10/2005 Ozment
2006/0278359 A1 12/2006 Wheaton et al.
2008/0099213 A1 5/2008 Morrow et al.
2008/0217026 A1 9/2008 Hursey
2011/0266009 A1 * 11/2011 Liu ..... 169/52

* cited by examiner

*Primary Examiner* — Dinh Q Nguyen
(74) *Attorney, Agent, or Firm* — Mitchell A. Rossman; Terra Nova Patent Law, PLLC

(57) ABSTRACT

A firefighting station is provided. The firefighting station includes an optional portable cart, one or more chemical foam proportioners, one or more first manifolds, one or more first valves, one or more first check valves, one or more second manifolds and one or more optional chemical fire suppression agent reservoirs. Methods of suppressing or preventing a fire are also provided.

2 Claims, 5 Drawing Sheets

FIREFIGHTING STATION

RELATED APPLICATIONS

This application claims priority to U.S. Provisional Patent Application Ser. No. 61/360,275, filed 30 Jun. 2010, which is hereby incorporated by reference in its entirety for all purposes.

BACKGROUND OF THE INVENTION

The addition of foaming agents and additives to firefighting water streams can be particularly useful for fighting fires, for example, fires in office buildings, industrial factories, chemical plants, petrochemical plants and petroleum refineries. The use of compressed air firefighting foam requires that air and a foam concentrate be mixed and added at constant proportions to the water stream. When the foam extinguisher solution is delivered, the foam effectively extinguishes the flames of chemical and petroleum fires, which would not be effectively extinguished by the application of water alone.

Compressed air foam technology improves the firefighting capacity of water and foam chemicals by producing a higher energy stream that penetrates the fire and by producing a higher quality foam bubble structure than is obtainable by other methods. The size of the compressed air foam bubble can be varied by controlling the ratio of compressed air to foam solution. Further, compressed air foam lines are lighter than water lines and place less stress on the firefighters and allow a greater degree of mobility. This facilitates reduced water damage, quicker fire knockdown, and a "safer" environment for both the firefighters and potential victims. Moreover, the compressed air foam will reduce the associated smoke damage by absorbing smoke from the air.

However, current compressed air foam systems are not applicable to being transported to space restricted areas or to be permanently fixed in space restricted areas.

What is needed is a firefighting station that is applicable to space restricted areas and can utilize existing pressurized air and water infrastructures.

SUMMARY OF THE INVENTION

The present invention provides a firefighting station. The firefighting station includes an optional portable cart, one or more chemical foam proportioners, one or more first manifolds, one or more first valves, one or more first check valves, one or more second manifolds and one or more optional chemical fire suppression agent reservoirs.

The firefighting station, as described herein, may be a rapid attack cart system. In this system, pressurized water is supplied from a hydrant, a portable pump, a relay station, for example, a fire truck, a home water system, an industrial type water connection, a feed from a hotel, or another fire hose station. The firefighting station would allow rapid response and deployment into areas where normal fire truck would not have the clearance to respond. For example, the firefighting station could be stationed or deployed in a high threat area, for example, an industrial conveyor belt in a restricted space. The firefighting station could be wheeled or permanently stationed near the fire area, hooked up to water hydrant and a source of pressurized air, and produce a chemical foam, a compressed air foam, water, a dry chemical fire suppression agent, or a combination thereof, either individually or simultaneously. The firefighting station could also be configured with break-apart feature for carrying or for storage in small compartments, for example, in a fire truck compartment. The firefighting station could also be stationed with permanent water and gas piping in hazardous areas of a plant or refueling center.

The present invention provides a firefighting station. The firefighting station includes:

an optional portable cart including one or more wheels;

one or more chemical foam proportioners each having one or more water inlets and one or more chemical foam outlets, wherein each of the one or more chemical foam proportioners is independently coupled to the optional portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

In one embodiment, the firefighting station including one or more first hoses each independently in fluid communication with one of the outlets of the one or more first valves and an inlet of the one or more fog nozzles. In one embodiment, the firefighting station including one or more second hoses each independently in fluid communication with one of the outlets of the one or more third valves and one or more compressed gas foam system nozzles.

In one embodiment, the optional portable cart includes one or more handles to position the firefighting station. In one embodiment, the one or more handles are collapsible. In one embodiment, the optional portable cart includes one or more storage compartments.

In one embodiment, the one or more storage compartments are used to carry the one or more first manifolds, the one or more first valves, the one or more first check valves, the one or more second valves, the one or more second manifolds, the one or more fog nozzles, the one or more compressed gas foam nozzles the one or more optional chemical fire suppression agent reservoirs, or a combination thereof, when the firefighting station is not in operation or is being transferred from a first place to a second place.

In one embodiment, the one or more optional chemical fire suppression agent reservoirs is independently coupled to the optional portable cart. In one embodiment, the optional portable cart includes a two-wheel hand truck. In one embodiment, the one or more chemical foam proportioners each independently include one or more dual tank and dual agent chemical foam proportioners. In one embodiment, the one or more foam proportioners each independently include one or more self-contained, positive pressure, and automatic foam concentrate to water proportioners.

In one embodiment, the one or more foam proportioners each independently include one or more proportioner rangers for Class A foam from about 0.01 volume percent to about 10.0 volume percent. In one embodiment, the one or more foam proportioners each independently include one or more proportioner rangers for Class A foam from about 0.1 volume percent to about 1.0 volume percent. In one embodiment, the one or more chemical foam proportioners each independently have a flow range for Class A Foam from about 1 gallon per minute to about 1000 gallons per minute. In one embodiment, the one or more chemical foam proportioners each independently have a flow range for Class A Foam from about 5 gallons per minute to about 500 gallons per minute.

In one embodiment, the one or more foam proportioners each independently include one or more proportioner rangers for one or more aqueous film-forming foams from about 1.0 volume percent to about 5.0 volume percent. In one embodiment, the one or more foam proportioners each independently include one or more proportioner rangers for one or more aqueous film-forming foams of about 3.0 volume percent. In one embodiment, the one or more chemical foam proportioners each independently have a flow range for one or more aqueous film-forming foams from about 1 gallon per minute to about 1000 gallons per minute.

In one embodiment, the one or more chemical foam proportioners each independently have a flow range for one or more aqueous film-forming foams from about 100 gallon per minute to about 200 gallons per minute. In one embodiment, the one or more chemical foam proportioners each independently have a flow range for one or more aqueous film-forming foams of about 150 gallon per minute. In one embodiment, the one or more chemical foam proportioners each independently have a maximum pressure drop from about 5 pounds per square inch per about 500 gallons per minute. In one embodiment, the one or more chemical foam proportioners each independently have a maximum pressure drop from about 10 pounds per square inch per about 100 gallons per minute. In one embodiment, the firefighting station provides plain water, one or more foam, one or more compressed gas foams, one or more dry chemical agents, or a combination thereof.

In one embodiment, the aspirated foam includes water, one or more chemical foams, and air. In one embodiment, the one or more chemical foams each independently include one or more Class A foams, one or more aqueous film-forming foams, or a combination thereof. In one embodiment, the one or more chemical foams each independently include one or more Class A foams.

In one embodiment, the one or more chemical foams each independently include one or more aqueous film-forming foams. In one embodiment, the one or more chemical foams each independently include one or more Class A foams and one or more aqueous film-forming foams. In one embodiment, the one or more water inlets each independently operate at a water pressure from about 20 pounds per square inch to about 2000 pounds per square inch. In one embodiment, the one or more water inlets each independently operate at a water pressure from about 30 pounds per square inch to about 1000 pounds per square inch. In one embodiment, the one or more water inlets each independently operate at a water pressure from about 50 pounds per square inch to about 450 pounds per square inch.

In one embodiment, the one or more chemical foam outlets each independently operate at a chemical foam pressure from about 20 pounds per square inch to about 2000 pounds per square inch. In one embodiment, the one or more chemical foam outlets each independently operate at a chemical foam pressure from about 30 pounds per square inch to about 1000 pounds per square inch. In one embodiment, the one or more chemical foam outlets each independently operate at a chemical foam pressure from about 50 pounds per square inch to about 450 pounds per square inch.

In one embodiment, the one or more fog nozzles each independently operate at a chemical foam pressure from about 20 pounds per square inch to about 2000 pounds per square inch. In one embodiment, the one or more fog nozzles each independently operate at a chemical foam pressure from about 30 pounds per square inch to about 1000 pounds per square inch. In one embodiment, the one or more fog nozzles each independently operate at a chemical foam pressure from about 50 pounds per square inch to about 450 pounds per square inch.

In one embodiment, the one or more gas compressors, one or more gas cylinders, or a combination thereof, each independently operate at a gas pressure from about 20 pounds per square inch to about 2000 pounds per square inch. In one embodiment, the one or more gas compressors, one or more gas cylinders, or a combination thereof, each independently operate at a gas pressure from about 30 pounds per square inch to about 1000 pounds per square inch. In one embodiment, the one or more gas compressors, one or more gas cylinders, or a combination thereof, each independently operate at a gas pressure from about 50 pounds per square inch to about 450 pounds per square inch.

In one embodiment, the one or more compressed gas foam nozzles each independently operate at a compressed gas foam pressure from about 20 pounds per square inch to about 2000 pounds per square inch. In one embodiment, the one or more compressed gas foam nozzles each independently operate at a compressed gas foam pressure from about 30 pounds per square inch to about 1000 pounds per square inch. In one embodiment, the one or more compressed gas foam nozzles each independently operate at a compressed gas foam pressure from about 50 pounds per square inch to about 450 pounds per square inch.

In one embodiment, the one or more water inlets each independently receive water from an industrial water source, a home water source, a vehicle water source, a fire hydrant, a pressurized water tank, or a combination thereof. In one embodiment, the one or more first valves each independently include one or more first gate valves one or more first gated wye valves, or a combination thereof. In one embodiment, the one or more second valves each independently include one or more second gate valves. In one embodiment, the one or more third valves each independently include one or more third gate valves, one or more third gated wye valves, or a combination thereof.

In one embodiment, the firefighting station further includes a fluid pump connected between the water source and the foam proportioner. The fluid pump serves to either boost the fluid pressure supplied by the external fluid source (e.g., fire hydrant) or to be able to draw fluid from a static water source, for example, a non-pressurized tank, a ditch, a stream, a lake, a river, a bay, an ocean, and the like, or combinations thereof.

The present invention provides a firefighting station. The firefighting station includes:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

The present invention provides a firefighting station. The firefighting station includes:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

The present invention provides a firefighting station. The firefighting station includes:

an optional portable cart including one or more wheels;

one or more chemical foam proportioners each having one or more water inlets and one or more chemical foam outlets, wherein each of the one or more chemical foam proportioners is independently coupled to the optional portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles.

The present invention provides a firefighting station. The firefighting station includes:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles.

The present invention provides a firefighting station. The firefighting station includes:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof The present invention also provides a method of suppressing or preventing a fire. The method includes:

providing a firefighting station including:

an optional portable cart including one or more wheels;

one or more chemical foam proportioners each having one or more water inlets and one or more chemical foam outlets, wherein each of the one or more chemical foam proportioners is independently coupled to the optional portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the chemical foam to one or more fog nozzles to the fire;

optionally mixing gas from one or more gas compressors, one or more gas cylinders, or a combination thereof, to generate a compressed gas foam; and optionally directing the compressed gas foam to the fire.

The present invention also provides a method of suppressing or preventing a fire. The method includes:

providing a firefighting station including:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a firefighting station including:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a firefighting station including:

an optional portable cart including one or more wheels;

one or more chemical foam proportioners each having one or more water inlets and one or more chemical foam outlets, wherein each of the one or more chemical foam proportioners is independently coupled to the optional portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles;

flowing water through the one or more chemical foam proportioners to produce a chemical foam;

optionally directing the chemical foam to one or more fog nozzles to the fire;

optionally mixing gas from one or more gas compressors, one or more gas cylinders, or a combination thereof, to generate a compressed gas foam; and optionally directing the compressed gas foam to the fire.

The present invention also provides a method of suppressing or preventing a fire. The method includes:

providing a firefighting station including:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a firefighting station including:

an optional portable cart including a two-wheel hand truck;

one or more chemical foam proportioners each having one or more water inlets and one or more chemical foam outlets, wherein each of the one or more chemical foam proportioners is independently coupled to the optional portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention provides a firefighting station. The firefighting station includes:

a portable cart including one or more wheels;

one or more chemical foam proportioners each having one or more water inlets and one or more chemical foam outlets, wherein each of the one or more chemical foam proportioners is independently coupled to the portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

The present invention provides a firefighting station. The firefighting station includes:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

The present invention provides a firefighting station. The firefighting station includes:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

The present invention provides a firefighting station. The firefighting station includes:

a portable cart including one or more wheels;

one or more chemical foam proportioners each having one or more water inlets and one or more chemical foam outlets, wherein each of the one or more chemical foam proportioners is independently coupled to the portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles.

The present invention provides a firefighting station. The firefighting station includes:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles.

The present invention provides a firefighting station. The firefighting station includes:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves one or more first gated wye valves, or a combination thereof;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof The present invention also provides a method of suppressing or preventing a fire. The method includes:

providing a portable firefighting station including:

a portable cart including one or more wheels;

one or more chemical foam proportioners each having one or more water inlets and one or more chemical foam outlets, wherein each of the one or more chemical foam proportioners is independently coupled to the portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the chemical foam to one or more fog nozzles to the fire;

optionally mixing gas from one or more gas compressors, one or more gas cylinders, or a combination thereof, to generate a compressed gas foam; and optionally directing the compressed gas foam to the fire.

The present invention also provides a method of suppressing or preventing a fire. The method includes:

providing a portable firefighting station including:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a portable firefighting station including:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a portable firefighting station including:

a portable cart including one or more wheels;

one or more chemical foam proportioners each having one or more water inlets and one or more chemical foam outlets, wherein each of the one or more chemical foam proportioners is independently coupled to the portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles;

flowing water through the one or more chemical foam proportioners to produce a chemical foam;

optionally directing the chemical foam to one or more fog nozzles to the fire;

optionally mixing gas from one or more gas compressors, one or more gas cylinders, or a combination thereof, to generate a compressed gas foam; and optionally directing the compressed gas foam to the fire.

The present invention also provides a method of suppressing or preventing a fire. The method includes:

providing a portable firefighting station including:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention also provides a method of suppressing or preventing a fire. The method includes:

providing a portable firefighting station including:

a portable cart including a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently include one or more self-contained, positive pressure and automatic foam concentrate to water proportioners;

wherein the one or more foam proportioners each independently include one or more self-contained, positive pressure and automatic foam concentrate to water proportioners, wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently include one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently include one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently include one or more third gate valves, one or more third gated wye valves, or a combination thereof;

flowing water through the one or more chemical foam proportioners to produce a chemical foam;

optionally directing the aspirated foam from one or more fog nozzles to the fire;

optionally mixing gas from the one or more gas compressors, the one or more gas cylinders, or a combination thereof, to generate a compressed gas foam; and optionally directing the compressed gas foam from the one or more compressed gas foam nozzles to the fire.

The present invention provides a firefighting station. The firefighting station includes:

an optional portable cart including one or more wheels;

one or more chemical foam proportioners each having one or more water inlets and one or more chemical foam outlets, wherein the one or more water inlets are in fluid connection with an outlet of a fluid pump having an inlet connected to a water source and an outlet, wherein each of the one or more chemical foam proportioners is independently coupled to the optional portable cart;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles; and one or more optional chemical fire suppression agent reservoirs each having an inlet and an outlet, wherein the inlet of each of the one or more optional chemical fire suppression agent reservoirs is placed in fluid communication with the outlets of one or more gas compressors, one or more gas cylinders, or a combination thereof, wherein the outlet of each of the one or more optional chemical fire suppression agent reservoirs is placed in fluid communication with the inlets one or more compressed gas check valves.

BRIEF DESCRIPTION OF THE DRAWINGS

Embodiments of the invention may be best understood by referring to the following description and accompanying drawings, which illustrate such embodiments. In the drawings.

Figure 1:
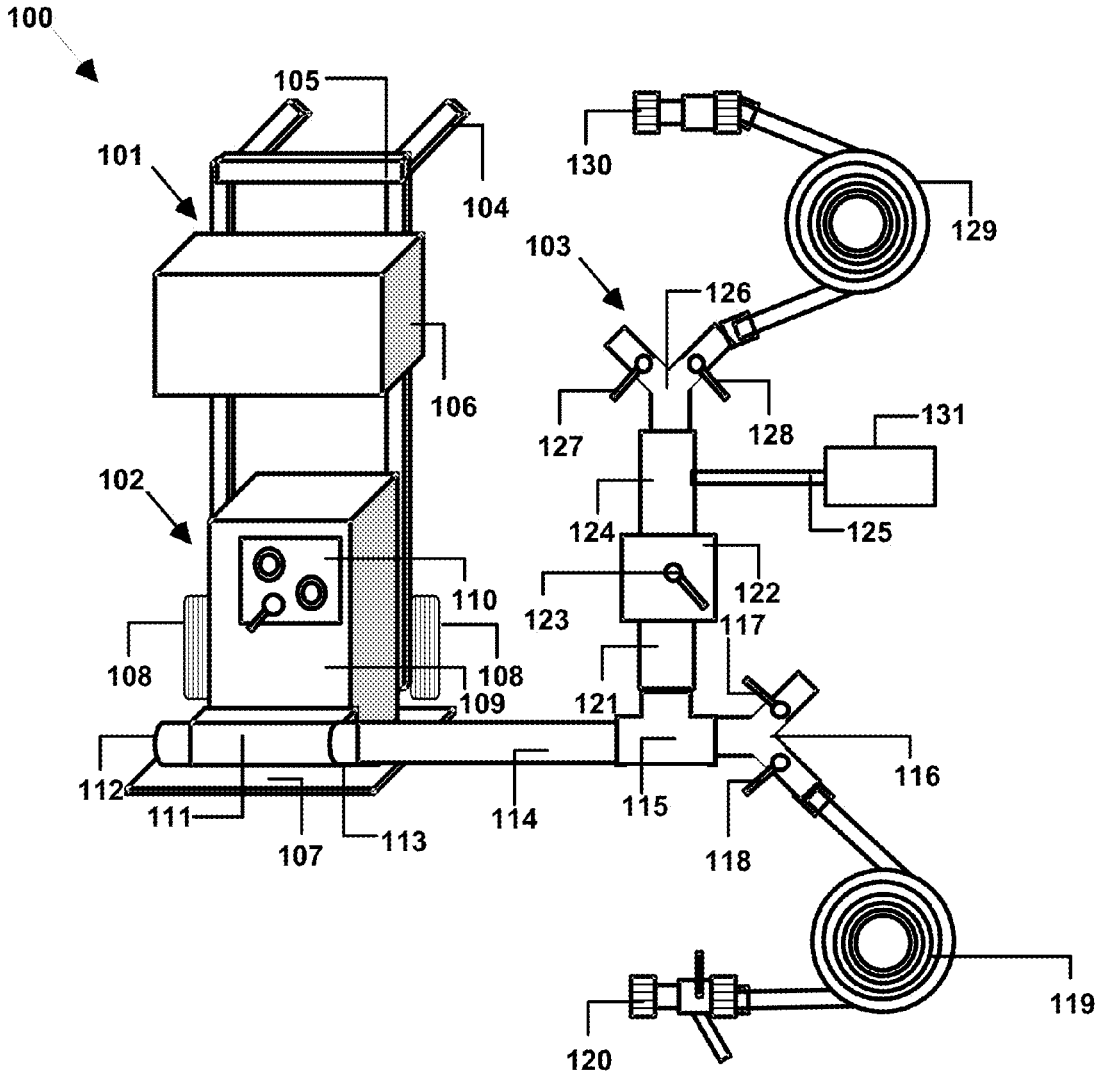
FIG. 1 is a front view drawing illustrating an exemplary portable firefighting station.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a firefighting station. The firefighting station includes an optional portable cart, one or more chemical foam proportioners, one or more first manifolds, one or more first valves, one or more first check valves, one or more second manifolds and one or more optional chemical fire suppression agent reservoirs.

The firefighting station, as described herein, may be a rapid attack cart system. In this system, pressurized water is supplied from a hydrant, a portable pump, a relay station, for example, a fire truck, a home water system, an industrial type water connection, a feed from a hotel, or another fire hose station. The firefighting station would allow rapid response and deployment into areas where normal fire truck would not have the clearance to respond. For example, the firefighting station could be stationed or deployed in a high threat area, for example, an industrial conveyor belt in a restricted space. The firefighting station could be wheeled or permanently stationed near the fire area, hooked up to water hydrant and a source of pressurized air, and produce a chemical foam, a compressed air foam, water, a dry chemical fire suppression agent, or a combination thereof, either individually or simultaneously. The firefighting station could also be configured with break-apart feature for carrying or for storage in small compartments, for example, in a fire truck compartment. The firefighting station could also be stationed with permanent water and gas piping in hazardous areas of a plant or refueling center.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "chemical fire suppression agent" refers to a powder or a fluid such as an inert liquid or gas that suppresses a fire by reducing, for example, the temperature of the fire, the availability of oxygen, the chemical reaction, and the like, or a combination thereof. As such, both two dimensional and three dimensional fires can be quickly and safely extinguished from a long distance.

As used herein, the term "compressed air foam system" or "CAFS" refer to is a system used in firefighting to deliver fire retardant foam for the purpose of extinguishing a fire or protecting unburned areas from becoming involved in a fire.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "foam chemical" refers to any chemical (e.g., solid, liquid, or gas) that may be used to produce foam. In one embodiment, the foam chemical includes, for example, a Class A foam, a Class B foam, a Class C foam, a Class D foam, or a combination thereof.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "suppressing or preventing a fire" refers to controlling, extinguishing, or preventing a fire. In one embodiment, the compressed gas foam systems, as described herein, are useful for protecting unburned areas from becoming involved in a fire.

As used herein, the terms "two dimensional fire" and "static fire" refers to the combustion of a non-replenishing fluid or solid. An example of a two dimensional or static fire is the burning of a fuel tank that is not being fed from a remote source.

As used herein, the terms "three dimensional fire" and "dynamic fire" refers to a fire that is fed by a remote replenishing source. A well blow out fire is an example of a three dimensional or dynamic fire.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

FIG. 1 is a front view drawing illustrating an exemplary portable firefighting station 100. The firefighting station 100 includes a portable cart 101, a foam proportionator 102, and a fluid handling system 103. The portable cart 101 includes two handles 104, a frame 105, a storage container 106, a base 107, and two wheels 108. The foam proportionator 102 includes a foam system 109, a control panel 110, a manifold 111, a water inlet 112, and a chemical foam outlet 113. A suitable foam proportionator 102 may be, for example, a Robwen Model 500P Foam Proportionator (Robwen Inc., Los Angeles, Calif. 90039). The fluid handling system 103 includes an optional first conduit 114, a first manifold 115, a first valve 116 that includes a first left switch 117 and a first right switch 118, a first hose 119, a foam nozzle 120, a first check valve 121, a second valve 122 that includes a second switch 123, a second manifold 124, a compressed gas inlet 125, a third valve 126 that include a third left switch 127 and a third right switch 128, a second hose 129, a compressed gas foam nozzle 130, and an air supply 131.

In one embodiment, the foam proportionator 102 may be, for example, a dual tank and dual agent chemical foam proportioner. In one embodiment, the foam proportionator 102 may be, for example, a self-contained, positive pressure, and automatic foam concentrate to water proportioner.

In one embodiment, the foam proportionator 102 may include, for example, a proportioner ranger for Class A foam from about 0.01 volume percent to about 10.0 volume percent. In one embodiment, the foam proportionator 102 may include, for example, a proportioner ranger for Class A foam from about 0.1 volume percent to about 1.0 volume percent.

In one embodiment, the foam proportionator 102 may have, for example, a proportioner ranger having a flow range for Class A Foam from about 1 gallon per minute to about 1000 gallons per minute. In one embodiment, the foam proportionator 102 may have, for example, a proportioner ranger having a flow range for Class A Foam from about 5 gallons per minute to about 500 gallons per minute.

In one embodiment, the foam proportionator 102 may include, for example, a proportioner ranger for one or more aqueous film-forming foams from about 1.0 volume percent to about 5.0 volume percent. In one embodiment, the foam proportionator 102 may include, for example, a proportioner ranger for one or more aqueous film-forming foams of about 3.0 volume percent. In one embodiment, the foam proportionator 102 may have, for example, a proportioner ranger having flow range for one or more aqueous film-forming foams from about 1 gallon per minute to about 1000 gallons per minute.

In one embodiment, the foam proportionator 102 may have, for example, a flow range for one or more aqueous film-forming foams from about 100 gallon per minute to about 200 gallons per minute. In one embodiment, the foam proportionator 102 may have, for example, a flow range for one or more aqueous film-forming foams of about 150 gallon per minute. In one embodiment, the foam proportionator 102 may have, for example, a maximum pressure drop from about 5 pounds per square inch per about 500 gallons per minute. In one embodiment, the foam proportionator 102 may have, for example, a maximum pressure drop from about 10 pounds per square inch per about 100 gallons per minute.

In one embodiment, the firefighting station 100 provides plain water, one or more foam, one or more compressed gas foams, or a combination thereof.

In one embodiment, the first valve 116 may be, for example, a gate valve or a gated wye valves. In one embodiment, the second valve 122 may be, for example, a gate valve. In one embodiment, the third valve 126 may be, for example, a gate valve or a gated wye valves. In one embodiment, the air supply 131 may be, for example, a supply conduit from an air compressor, an air compressor, an air cylinder, or a combination thereof.

In one embodiment, the system operator, for example, a firefighter, can set controls manually with hand-operated valves and levers or via control panel (not shown) that is operatively coupled to a system controller (not shown). In one embodiment, the system controller (not shown) is operatively coupled to one or more components of the firefighting station.

Figure 2:
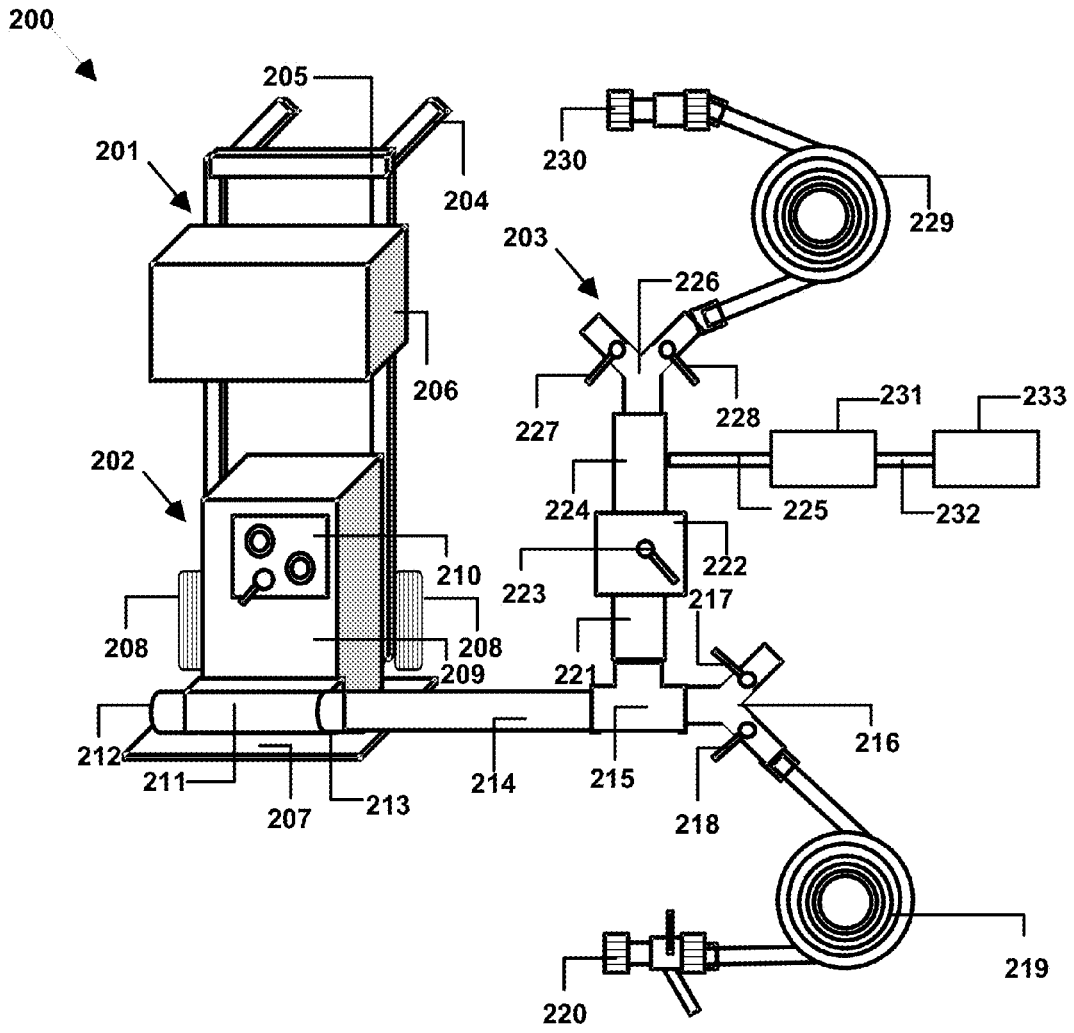
FIG. 2 is a front view drawing illustrating an exemplary portable firefighting station with a dry chemical fire suppressing agent capability.

FIG. 2 is a front view drawing illustrating an exemplary portable firefighting station 200 with a dry chemical fire suppressing agent capability. The firefighting station 200 includes a portable cart 201, a foam proportionator 202, and a fluid handling system 203. The portable cart 201 includes two handles 204, a frame 205, a storage container 206, a base 207, and two wheels 208. The foam proportionator 202 includes a foam system 209, a control panel 210, a manifold 211, a water inlet 212, and a chemical foam outlet 213. A suitable foam proportionator 202 may be, for example, a Robwen Model 500P Foam Proportionator (Robwen Inc., Los Angeles, Calif. 90039). The fluid handling system 203 includes an optional first conduit 214, a first manifold 215, a first valve 216 that includes a first left switch 217 and a first right switch 218, a first hose 219, a foam nozzle 220, a first check valve 221, a second valve 222 that includes a second switch 223, a second manifold 224, a compressed gas inlet 225, a third valve 226 that include a third left switch 227 and a third right switch 228, a second hose 229, a compressed gas foam nozzle 230, a chemical fire suppression reservoir 231, a second conduit 232, and an air supply 233.

In one embodiment, the compressed gas foam nozzle 230 may be a normal compressed gas foam nozzle. In one embodiment, the compressed gas foam nozzle 230 may be a liquid and chemical fire suppression agent nozzle for fire extinction. Suitable nozzles are described in U.S. Pat. Nos. 5,167,285 and 5,312,041.

The nozzle described in the U.S. Pat. No. 5,167,285, is marketed under the Hydrochem trade name, and throws a stream of dry powder or chemical within a stream of liquid or foam by injecting the dry powder or chemical stream into the middle of the liquid or foam solution stream at the nozzle discharge port. The dry chemical stream is projected with and, to a certain extent, by the liquid/foam stream. When simultaneously dispensed by Hydrochem-type nozzles, liquid agent streams are able to carry desired dry chemical streams to a fire apparently by entrapping, encapsulating, or entraining them within the fluid stream. Yet, the chemical performs like a "dry" chemical at the fire. Such transport with or in the liquid stream has enabled application of dry chemical agents from considerably greater distances than was previously possible.

In a similar fashion, the nozzle described in the U.S. Pat. No. 5,312,041 throws a stream of second fluid or an inert gas within a stream of liquid or foam by injecting the inert gas into the middle of the liquid or foam solution stream at the nozzle discharge port. The second fluid or an inert gas is projected with and, to a certain extent, by the liquid/foam stream. When simultaneously dispensed by Hydrochem-type nozzles, liquid agent streams are able to carry desired second fluid or an inert gas to a fire apparently by entrapping, encapsulating, or entraining them within the fluid stream. Such transport with or in the liquid stream has enabled application of a second fluid or an inert gas from considerably greater distances than was previously possible.

In one embodiment, the chemical fire suppression agent is a powder. In one embodiment, the powder is sodium bicarbonate, potassium bicarbonate, sodium chloride, silicone powder, or a combination thereof.

In one embodiment, the chemical fire suppression agent includes an inert gas at atmospheric conditions. In one embodiment, the inert gas includes carbon dioxide.

In one embodiment, the system operator, for example, a firefighter, can set controls manually with hand-operated valves and levers or via control panel (not shown) that is operatively coupled to a system controller (not shown). In one embodiment, the system controller (not shown) is operatively coupled to one or more components of the firefighting station.

Figure 3:
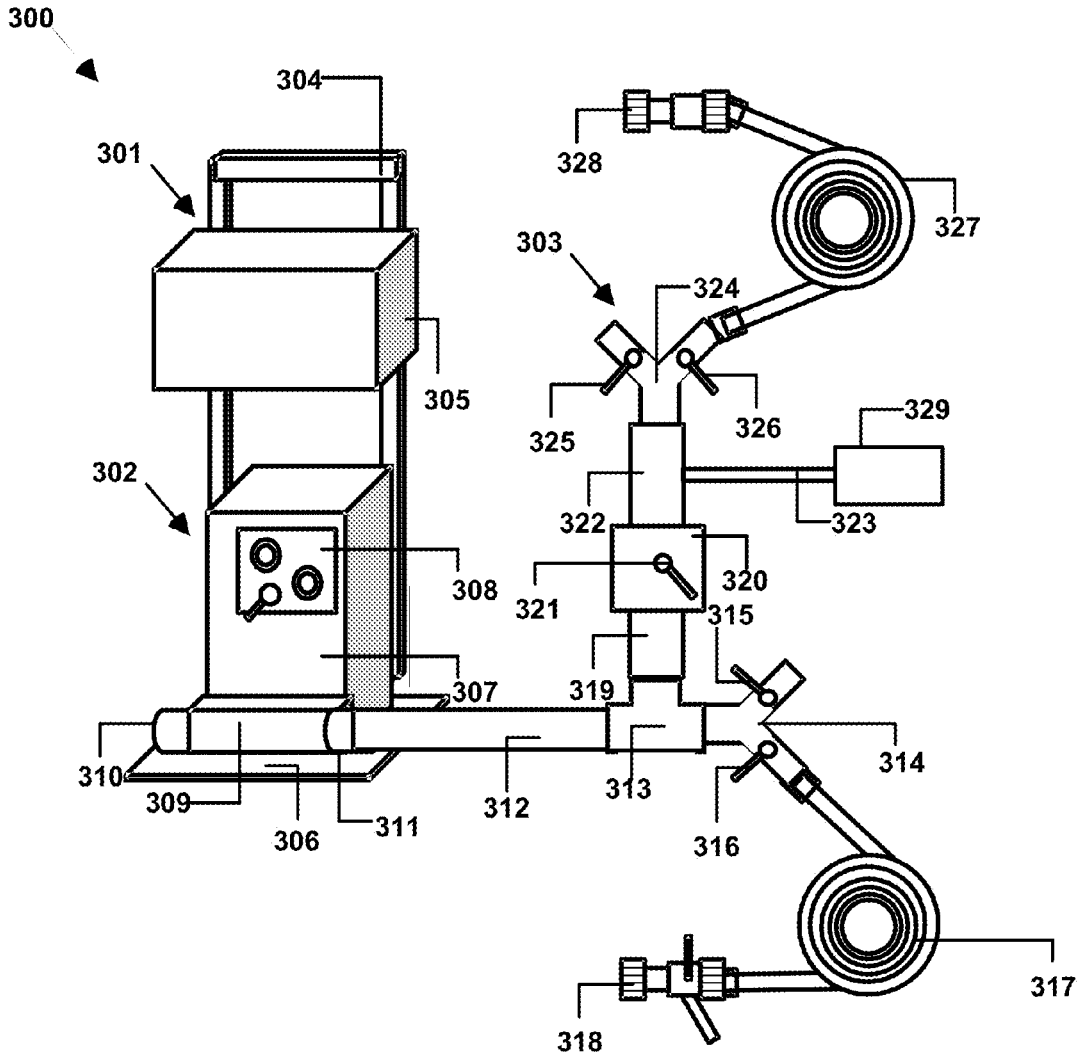
FIG. 3 is a front view drawing illustrating an exemplary fixed firefighting station.

FIG. 3 is a front view drawing illustrating an exemplary fixed firefighting station 300. The firefighting station 300 includes a fixed station 301, a foam proportionator 302, and a fluid handling system 303. The fixed station 301 includes a frame 304, a storage container 305, and a base 306. The foam proportionator 302 includes a foam system 307, a control panel 308, a manifold 309, a water inlet 310, and a chemical foam outlet 311. A suitable foam proportionator 302 may be, for example, a Robwen Model 500P Foam Proportionator (Robwen Inc., Los Angeles, Calif. 90039). The fluid handling system 303 includes an optional first conduit 312, a first manifold 313, a first valve 314 that includes a first left switch 315 and a first right switch 316, a first hose 317, a foam nozzle 318, a first check valve 319, a second valve 320 that includes a second switch 321, a second manifold 322, a compressed gas inlet 323, a third valve 324 that include a third left switch 325 and a third right switch 326, a second hose 327, a compressed gas foam nozzle 328, and an air supply 329.

In one embodiment, the system operator, for example, a firefighter, can set controls manually with hand-operated valves and levers or via control panel (not shown) that is operatively coupled to a system controller (not shown). In one embodiment, the system controller (not shown) is operatively coupled to one or more components of the firefighting station.

Figure 4:
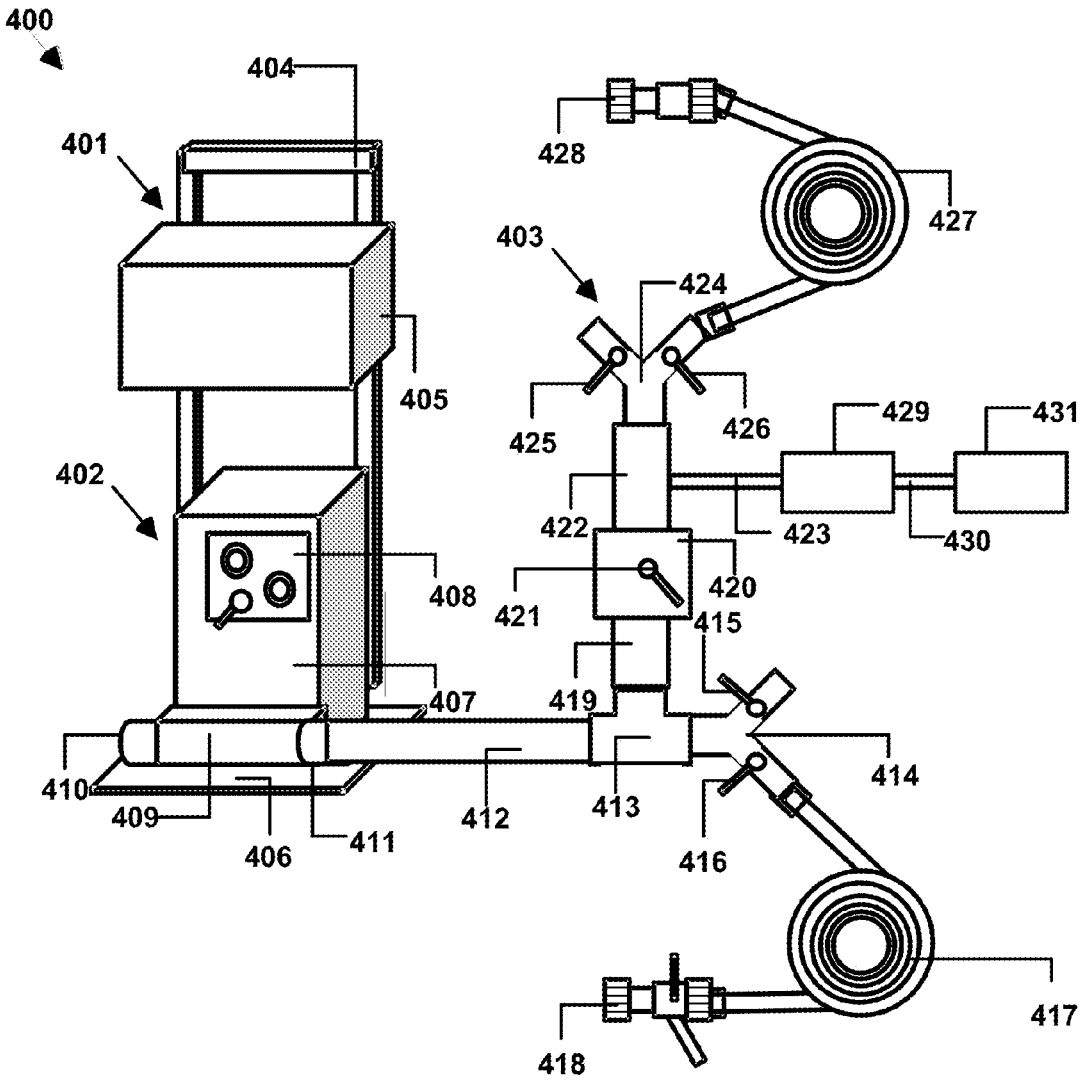
FIG. 4 is a front view drawing illustrating an exemplary fixed firefighting station with a dry chemical fire suppressing agent capability.

FIG. 4 is a front view drawing illustrating an exemplary fixed firefighting station 400 with a dry chemical fire suppressing agent capability. The firefighting station 400 includes a fixed station 401, a foam proportionator 402, and a fluid handling system 403. The fixed station 401 includes a frame 404, a storage container 405, and a base 406. The foam proportionator 402 includes a foam system 407, a control panel 408, a manifold 409, a water inlet 410, and a chemical foam outlet 411. A suitable foam proportionator 402 may be, for example, a Robwen Model 500P Foam Proportionator (Robwen Inc., Los Angeles, Calif. 90039). The fluid handling system 403 includes an optional first conduit 412, a first manifold 413, a first valve 414 that includes a first left switch 415 and a first right switch 416, a first hose 417, a foam nozzle 418, a first check valve 419, a second valve 420 that includes a second switch 421, a second manifold 422, a compressed gas inlet 423, a third valve 424 that include a third left switch 425 and a third right switch 426, a second hose 427, a compressed gas foam nozzle 428, a chemical fire suppression reservoir 429, a second conduit 430, and an air supply 431.

In one embodiment, the compressed gas foam nozzle 428 may be a normal compressed gas foam nozzle. In one embodiment, the compressed gas foam nozzle 428 may be a liquid and chemical fire suppression agent nozzle for fire extinction. Suitable nozzles are described in U.S. Pat. Nos. 5,167,285 and 5,312,041.

The nozzle described in the U.S. Pat. No. 5,167,285, is marketed under the Hydrochem trade name, and throws a stream of dry powder or chemical within a stream of liquid or foam by injecting the dry powder or chemical stream into the middle of the liquid or foam solution stream at the nozzle discharge port. The dry chemical stream is projected with and, to a certain extent, by the liquid/foam stream. When simultaneously dispensed by Hydrochem-type nozzles, liquid agent streams are able to carry desired dry chemical streams to a fire apparently by entrapping, encapsulating, or entraining them within the fluid stream. Yet, the chemical performs like a "dry" chemical at the fire. Such transport with or in the liquid stream has enabled application of dry chemical agents from considerably greater distances than was previously possible.

In a similar fashion, the nozzle described in the U.S. Pat. No. 5,312,041 throws a stream of second fluid or an inert gas within a stream of liquid or foam by injecting the inert gas into the middle of the liquid or foam solution stream at the nozzle discharge port. The second fluid or an inert gas is projected with and, to a certain extent, by the liquid/foam stream. When simultaneously dispensed by Hydrochem-type nozzles, liquid agent streams are able to carry desired second fluid or an inert gas to a fire apparently by entrapping, encapsulating, or entraining them within the fluid stream. Such transport with or in the liquid stream has enabled application of a second fluid or an inert gas from considerably greater distances than was previously possible.

In one embodiment, the chemical fire suppression agent is a powder. In one embodiment, the powder is sodium bicarbonate, potassium bicarbonate, sodium chloride, silicone powder, or a combination thereof.

In one embodiment, the chemical fire suppression agent includes an inert gas at atmospheric conditions. In one embodiment, the inert gas includes carbon dioxide.

In one embodiment, the system operator, for example, a firefighter, can set controls manually with hand-operated valves and levers or via control panel (not shown) that is operatively coupled to a system controller (not shown). In one embodiment, the system controller (not shown) is operatively coupled to one or more components of the firefighting station.

Figure 5:
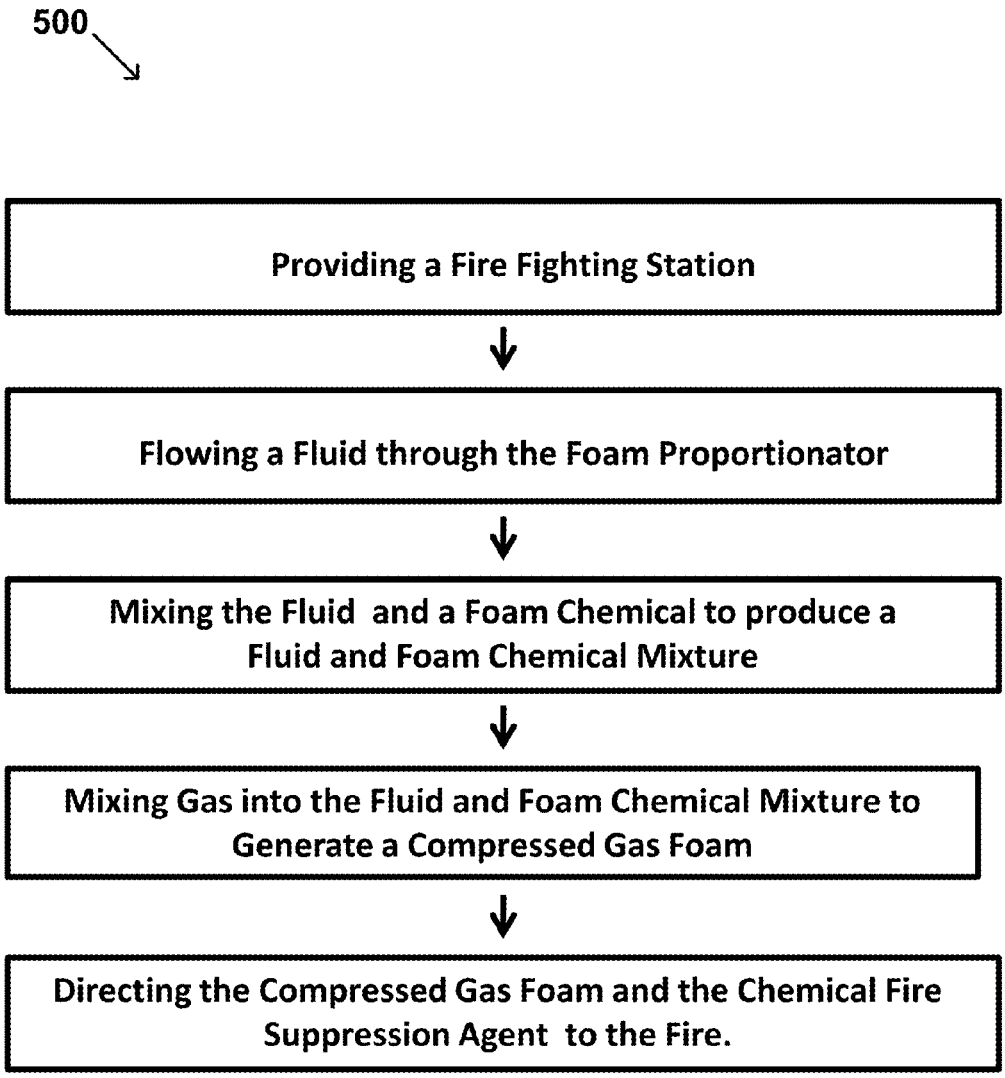
FIG. 5 is a block diagram illustrating an exemplary method of suppressing or preventing a fire.

FIG. 5 is a block diagram illustrating an exemplary method 500 of suppressing or preventing a fire. The method 500 includes; providing a firefighting station; flowing a fluid through a flow path through the firefighting station; mixing the fluid and a foam chemical to produce a fluid and foam chemical mixture; mixing gas into the fluid and foam chemical mixture to generate a compressed gas foam; and directing the compressed gas foam and the chemical fire suppression agent to the fire.

In FIGS. 1-4, as described herein, the components of the firefighting station may be each independently coupled to send and receive signals from the system controller so that the system controller may control all operations within the firefighting station. Any number of check valves may also be included in the conduits of the firefighting station to prevent back flow of the fluid or gas. Any number of fluid regulators may be included in the conduits of the firefighting station to regulate the fluid flow as needed. Any number of gas regulators may be included in the conduits of the firefighting station to regulate the gas flow as needed. Any number of control devices, flow sensor, pressure sensor, and the like, or combinations thereof, may be used in the firefighting station to regulate the ratios of gas to fluid, gas to foam chemical, fluid to foam chemical, or combinations thereof, as needed.

In FIGS. 1-4, as described herein, the firefighting stations may also include a fluid pump upstream of the foam proportionator to either boost the fluid pressure supplied by the external fluid source (e.g., fire hydrant) or to be able to draw fluid from a static water source, for example, a non-pressurized tank, a ditch, a stream, a lake, a river, a bay, an ocean, and the like, or combinations thereof.

In FIGS. 1-4, as described herein, all of the firefighting stations may also include a fluid pump downstream of the foam proportionator to boost the fluid pressure of the foam, the compressed gas foam, the water, or a combination thereof.

The chemical foam systems, for example, may each independently contain foam fire retardant that is a class A foam available under various trade names. Class A foam is useful for fires involving solid combustibles, building materials, structures, rubbish, vehicles, industrial, marine, wild lands, and the like. Other classes of foam can be stored in the one or more foam systems. For example, class B foam is used for flammable liquid fires, class C foam is more effective against electrical fires, and class D foam is best suited for combustible metals. The one or more foam systems may contain other fire retardants and chemical agents.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A portable firefighting station comprising:

a portable cart comprising a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently comprise one or more self-contained, positive pressure and automatic foam concentrate to water proportioners;

wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently comprise one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently comprise one or more first gate valves, one or more first gated wye valves, or a combination thereof;

one or more first check valves each independently in fluid communication with the second outlet of the one or more first manifolds and an inlet of one or more second valves; and one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently comprise one or more third gate valves, one or more third gated wye valves, or a combination thereof.

2. A method of suppressing or preventing a fire comprising:

providing a portable firefighting station comprising:

a portable cart comprising a two-wheel hand truck;

one or more chemical foam proportioners each having one or more water inlets and one or more chemical foam outlets, wherein each of the one or more chemical foam proportioners is independently coupled to the portable cart, wherein the one or more foam proportioners each independently comprise one or more self-contained, positive pressure and automatic foam concentrate to water proportioners;

wherein the one or more chemical foam proportioners each independently have a maximum pressure drop from about 10 pounds per square inch per about 100 gallons per minute, wherein the one or more chemical foam proportioners each independently have a flow range for one or more aqueous film-forming foams of about 150 gallon per minute, wherein the one or more foam proportioners each independently comprise one or more proportioner rangers for one or more aqueous film-forming foams of about 3.0 volume percent, wherein the one or more chemical foam proportioners each independently have a flow range for Class A Foam from about 5 gallons per minute to about 500 gallons per minute;

one or more first manifolds each having an inlet, a first outlet, and a second outlet, wherein each inlet is independently in fluid communication with the one or more chemical foam outlets, one or more first valves each having an inlet and one or more outlets, wherein each inlet of the one or more first valves each independently in fluid communication with the first outlet of each of the one or more first manifolds, wherein one or more of the outlets of the one or more first valves provide aspirated foam to an inlet of one or more fog nozzles, wherein the one or more first valves each independently comprise one or more first gate valves, one or more first gated wye valves, or a combination thereof;

one or more first check valves each independently in fluid communication with the second outlet of the one or more first manifolds and an inlet of one or more second valves;

one or more second manifolds each having a first inlet, a second inlet, and an outlet, wherein the first inlet of the one or more second manifolds is in fluid communication with an outlet of the one or more second valves, wherein the second inlet of the one or more second manifolds is in fluid communication with an outlet of one or more compressed gas check valves, wherein an inlet of one or more compressed gas check valves is configured to receive one or more compressed gases from the outlets of one or more gas compressors, one or more gas cylinders, or a combination thereof;

wherein the outlet of the one or more second manifolds is in fluid communication with an inlet of one or more third valves, wherein one or more of the outlets of the one or more third valves provide one or more compressed gas foams to an inlet of one or more compressed gas foam nozzles, wherein the one or more third valves each independently comprise one or more third gate valves, one or more third gated wye valves, or a combination thereof;

flowing water through the one or more chemical foam proportioners to produce a chemical foam;

directing the aspirated foam from one or more fog nozzles to the fire;

mixing gas from the one or more gas compressors, the one or more gas cylinders, or a combination thereof, to generate a compressed gas foam; and directing the compressed gas foam from the one or more compressed gas foam nozzles to the fire.

* * * * *